US007343843B2

(12) United States Patent
Sharpe et al.

(10) Patent No.: US 7,343,843 B2
(45) Date of Patent: Mar. 18, 2008

(54) EXPLOSIVE EFFECT MITIGATED CONTAINERS AND ENCLOSING DEVICES

(75) Inventors: Kevin John Sharpe, Essex (GB); Jack Waddell, Houston, TX (US); James F. Gordon, Nokomis, FL (US)

(73) Assignee: Blast Gard International, Clearwater, FL (US)

( * ) Notice: Subject to any disclaimer, the term of this patent is extended or adjusted under 35 U.S.C. 154(b) by 308 days.

(21) Appl. No.: 11/042,318

(22) Filed: Jan. 26, 2005

(65) Prior Publication Data

US 2005/0242093 A1 Nov. 3, 2005

Related U.S. Application Data

(63) Continuation-in-part of application No. 10/834,165, filed on Apr. 29, 2004, which is a continuation-in-part of application No. 10/630,897, filed on Jul. 31, 2003.

(51) Int. Cl.
*F41H 5/06* (2006.01)
*F41H 5/24* (2006.01)

(52) U.S. Cl. ..... 86/50; 89/36.02

(58) Field of Classification Search ..... 2/2.5; 86/50; 89/36.02

See application file for complete search history.

(56) References Cited

U.S. PATENT DOCUMENTS

| | | | | |
|---|---|---|---|---|
| 2,602,302 | A | | 7/1952 | Poux et al. |
| 2,733,177 | A | | 1/1956 | Meyer |
| 2,738,297 | A | | 3/1956 | Pfistershammer |
| 2,974,788 | A | | 3/1961 | Robbins |
| 3,331,322 | A | | 7/1967 | Belanger |
| 3,360,014 | A | | 12/1967 | Poisson et al. |
| 3,371,604 | A | | 3/1968 | Per Folke Wikner et al. |
| 3,491,847 | A | | 1/1970 | Abbott |
| 3,577,836 | A | * | 5/1971 | Tamura ..... 2/2.5 |
| 3,625,872 | A | * | 12/1971 | Ashida ..... 521/175 |
| 3,736,838 | A | | 6/1973 | Butterweck et al. |
| 3,801,416 | A | | 4/1974 | Gulbierz |
| 4,184,788 | A | | 1/1980 | Colle |
| 4,251,579 | A | | 2/1981 | Lee et al. |
| 4,287,250 | A | | 9/1981 | Rudy |
| 4,299,872 | A | | 11/1981 | Miguel et al. |
| 4,369,885 | A | | 1/1983 | Redmond |
| 4,700,706 | A | | 10/1987 | Munch |

(Continued)

FOREIGN PATENT DOCUMENTS

EP 0276918 A1 8/1988

(Continued)

OTHER PUBLICATIONS

Hawley, G. G., The Condensed Chemical Dictionary, p. 706, Jan. 6, 1974.

(Continued)

*Primary Examiner*—Stephen M Johnson
(74) *Attorney, Agent, or Firm*—Browdy and Neimark, PLLC

(57) ABSTRACT

Containers and enclosing devices such as pipes or tires can be protected from explosive shocks and blasts by incorporating blast mitigating material in at least one of the top and bottom sides of a container, or by wrapping or lining the enclosing device with a blast mitigating material.

3 Claims, 5 Drawing Sheets

U.S. PATENT DOCUMENTS

| | | | | |
|---|---|---|---|---|
| 4,750,318 | A | 6/1988 | Matsuzawa | |
| 4,836,079 | A | 6/1989 | Barrett | |
| 4,966,365 | A | 10/1990 | William et al. | |
| 5,076,166 | A | 12/1991 | Yoshida et al. | |
| 5,110,661 | A | 5/1992 | Groves | |
| 5,155,959 | A | 10/1992 | Richards | |
| 5,156,290 | A | 10/1992 | Rodrigues | |
| 5,196,254 | A | 3/1993 | Akiyama | |
| 5,225,622 | A | 7/1993 | Gettle et al. | |
| 5,287,961 | A | 2/1994 | Herran | |
| 5,299,862 | A | 4/1994 | Rankine | |
| 5,309,690 | A | 5/1994 | Symons | |
| 5,312,182 | A | 5/1994 | Mlakar et al. | |
| 5,333,532 | A | 8/1994 | Smirlock et al. | |
| 5,340,632 | A | 8/1994 | Chappuis | |
| 5,394,786 | A * | 3/1995 | Gettle et al. | 86/50 |
| 5,413,410 | A | 5/1995 | Mlakar | |
| 5,534,343 | A | 7/1996 | Landi et al. | |
| 5,563,364 | A | 10/1996 | Alhamad | |
| 5,576,511 | A | 11/1996 | Alhamad | |
| 5,595,431 | A | 1/1997 | Mlakar | |
| 5,599,082 | A | 2/1997 | Mlakar et al. | |
| 5,686,689 | A | 11/1997 | Snedeker et al. | |
| 5,729,830 | A * | 3/1998 | Luhtala | 2/2.5 |
| 5,738,925 | A | 4/1998 | Chput | |
| 5,739,458 | A | 4/1998 | Girard | |
| 5,783,297 | A | 7/1998 | Wise et al. | |
| 5,830,548 | A | 11/1998 | Anderson et al. | |
| 5,849,394 | A | 12/1998 | Bussey, III et al. | |
| 5,996,115 | A | 12/1999 | Mazelsky | |
| 6,177,368 | B1 | 1/2001 | Fisher | |
| 6,244,155 | B1 | 6/2001 | Sparks | |
| 6,279,399 | B1 | 8/2001 | Holm | |
| 6,289,816 | B1 | 9/2001 | Keenan et al. | |
| 6,341,708 | B1 | 1/2002 | Palley et al. | |
| 6,644,165 | B1 * | 11/2003 | King | 86/50 |
| 6,688,989 | B2 * | 2/2004 | Best | 473/332 |
| 6,701,529 | B1 * | 3/2004 | Rhoades et al. | 2/2.5 |
| 6,782,792 | B1 | 8/2004 | Edberg et al. | |
| 6,805,035 | B2 | 10/2004 | Edberg et al. | |
| 6,858,280 | B2 * | 2/2005 | Allen et al. | 428/69 |
| 7,036,418 | B2 * | 5/2006 | Greenfield et al. | 86/50 |
| 2003/0209133 | A1 | 11/2003 | Greenfield et al. | |
| 2004/0091181 | A1 | 5/2004 | James | |
| 2004/0107827 | A1 | 6/2004 | Edberg et al. | |
| 2004/0118272 | A1 | 6/2004 | Edberg et al. | |
| 2004/0154463 | A1 | 8/2004 | Edherg et al. | |

FOREIGN PATENT DOCUMENTS

| | | |
|---|---|---|
| EP | 0312399 A1 | 4/1989 |
| EP | 1229298 A1 | 8/2002 |
| FR | 2602038 A1 | 1/1988 |
| FR | 2607241 A1 | 5/1988 |

OTHER PUBLICATIONS

Brady, G. S., Materials Handbook, pp. 642-644, Jul. 1, 1959.
Webster's Unabridged Dictionary, p. 1442, 1996.
Collins English Dictionary, 2000.
Transcript: MSNBC Interview of Jack Waddell, Nov. 24, 2004.
Ad for BOXAP Explosive Mitigating Litter Bins no date provided.
Letter from Police Scientific Developement Branch, U.K., to Mr. Zuill, Hexcell UK Limited, Feb. 9, 1994.

* cited by examiner

Figure 10: Blast Pressure Measurements vs. Free Field Blast Lung Overpressure Injury Criteria

EXPLOSIVE EFFECT MITIGATED CONTAINERS AND ENCLOSING DEVICES

CROSS REFERENCE TO RELATED APPLICATIONS

This application is a continuation in part of application Ser. No. 10/834,165, filed Apr. 29, 2004 which is a continuation in part of application Ser. No. 10/630,897, filed Jul. 31, 2003, the entire contents both of which are hereby incorporated by reference.

FIELD OF THE INVENTION

The present invention relates to blast-mitigated container assemblies for use in densely populated areas, such as refuse containers, mail boxes, enclosing devices and the like, as well as to methods for protecting pipelines from damage by explosion.

BACKGROUND OF THE INVENTION

It is an unfortunate fact that terrorists often attempt to influence the course of political events through the use of violence. One infamous means of implementing these violent actions is by strategically placing bombs wherein they will cause the greatest devastation and have the greatest political impact, such as by placing bombs in mailboxes or trash containers in densely populated areas. Likewise, land mines are placed in areas of traffic so that the victims will be affected when the vehicle traverses the mine. Indeed, bombs seem almost to be a weapon of choice for terrorists. As is well known, terrorist targets are typically chosen on the basis of their vulnerability to such attack and are frequently, if not purposefully, selected without regard for human life.

Crowds of people can, therefore, be an attractive terrorist target due to the intense public reaction that mass murder evokes. Containers located in crowded areas, such as mailboxes and trash containers, are also attractive targets for terrorists.

Because mailboxes and trash containers are so ubiquitous in densely populated areas, it is nearly impossible to monitor all of these containers for the presence of bombs. Moreover, even though explosive detection devices are currently available, there remains a threshold bomb size above which detection is relatively easy, but below which an increasing proportion of bombs will go undetected, even if it were feasible to monitor mailboxes and trash containers continuously.

Because mines can be placed anywhere, it is nearly impossible to determine if a road has been mined or if all suspected mines have been disabled. Explosive devices produce high velocity fragmentation emanating both from the device casing and from material close to the point of explosion, so-called secondary fragmentation. In addition, explosive devices produce shock waves that can be characterized by having a rise time that is a virtual discontinuity in the physical properties of the material through which it propagates. These shock waves produce the potentially highly damaging phenomenon known as blast. Shock waves travel at a speed related to their amplitude, with higher pressure traveling faster than lower pressures, and the characteristics of the given medium. Once produced, the shock wave propagates outwardly from the source of the explosion, obeying well-understood physical laws. These laws, the conservation of mass, momentum, and energy, describe how the shock propagates from medium to medium with the associated changes in velocity and pressure. Shocks propagating spherically away from the source of the explosion will drop in pressure very rapidly. The decay in pressure generated within or close to structure is highly dependant on the geometry surrounding the explosion. Reflective barriers, tunnels, corners, and many other structural features can reduce the rate at which the shock wave decays, and, in some circumstances, locally increase pressure.

Currently available blast resistant trash receptacles are said to protect against explosive threats that are as large as ten pounds. However, the protection provided by these containers is that the blast resistant receptacle does not come apart under the explosive loading from a large internal detonation. However, protecting against an explosive event of this magnitude is a far more challenging task than merely ensuring that the receptacle remains intact.

Another terrorist target is pipelines which carry oil and gas. An extreme amount of disruption can be caused by destroying part of a pipeline.

There are currently no guidelines for the manufacturers of explosion mitigating containers (i.e., containers or enclosing devices that dramatically reduce the hazardous effects to the public from an internal explosion), and there are no accepted standards for testing or certification of these devices.

SUMMARY OF THE INVENTION

It is an object of the present invention to overcome the aforesaid deficiencies in the prior art.

It is another object of the present invention to provide containers equipped with blast-mitigating material in the tops or lids of the containers.

It is another object of the present invention to provide containers for use on ships, trucks and aircraft as well as in public places that contain blast-mitigating material in the tops or lids of the containers.

It is another object of the present invention to provide containers equipped with blast-mitigating material lining the bottoms of the container.

It is a further object of the present invention to provide containers for use on ships, trucks and aircraft as well as for public places that contain blast-mitigating material lining the bottoms of the containers.

It is yet another object of the present invention to provide containers that contain blast-mitigating material in the top or lid and lining the sides and bottoms of the containers.

It is still another object of the present invention to provide liners for the lids or tops of containers located in public places to mitigate the effects of an explosive device in the containers.

It is a further object of the present invention to provide ways to protect pipes and pipelines from damage caused by explosions.

This is still another object of the present invention to provide ways to protect vehicle tires from damage caused by explosions.

Correct identification of the threat that a system must survive is crucial to a successful design of an effective protection solution. Hazard Management Solutions, Ltd. conducted a review of terrorist threats that have involved trash receptacles going back over the previous 30 years. The current worst case threats based on previous global experience are:

Steel pipe bomb filled with ½ pound of smokeless Powder 1 kg TNT bare charge

The research undertaken by HMS Ltd has shown that the size of device that finds its way into trash containers, historically, has been relatively small, since a small device can be easily and inconspicuously dropped into a bin, perhaps concealed in a paper bag or another apparent article of trash; However, a ten-pound explosive charge is not so easily deposited. If formed into a sphere, such a charge would have a diameter of seven inches, and when combined with a timing and power unit (TPU), shrapnel and packaging, it would be relatively bulky. Dumping such a bulky package into a trash receptacle is an unusual act and may draw attention. If a charge of this size is taken to be a credible threat, rather than harden the bin to ensure that it did not rupture under the massive explosive loading generated by such a large charge, the size of the aperture in the trash receptacle could be restricted to prevent deposit of such a large charge.

The present invention provides blast-mitigating containers in which the blast mitigating material is located in the lids, sides, and/or tops of the containers, or in the bottom of the containers, or in both the top and bottom of the containers. These containers can include mail boxes, trash or refuse containers, or containers for shipping goods in aircraft, ships, trains, and/or trucks, in order to prevent or minimize damage in the event of an on board explosion. These containers can be provided with apertures for depositing trash or mail, which apertures are too small to admit a large item such as a ten-pound charge.

The blast mitigating liners for the lids or tops and/or bottoms of containers can combine a shock attenuating, blast mitigating material such as, but not limited to, BLASTWRAP™, integrated into a container made from a strong anti-ballistic, such as, but not limited to, KEVLAR®. The face of the liner exposed to the source of the explosion can be manufactured from a frangible material such as, but not limited to, a thin fiberglass layer. The purpose of this liner is to breach rapidly in contact with the blast wave and allows the burning detonation products to mix with the BLASTWRAP™ contents. This concept is denominated the explosion-mitigating cassette.

This same type of liner can be used to protect pipes and pipelines from damage caused by explosives. The pipe or pipeline is wrapped with blast-mitigating material, preferably BLASTWRAP™, which protects the pipe or pipeline from explosive shock.

In a similar fashion, the blast mitigating liner can be used to protect vehicle tires from damage caused by explosives, such as mines. In this case either part of or the entire inside of the tire is lined with a blast-mitigating material, such as BLASTWRAP™, so that, upon contact with an explosive device, the blast mitigating material absorbs the shocks produced and thus maintains the tire's ability to support and carry a vehicle.

The container assembly of the present invention comprises a container such as, but not limited to, a mailbox, trash or refuse container, containers for use in aircraft, trucks, trains, ships, and buses. The blast mitigating material is incorporated in the lid of the container, or is fitted to the top of the container during manufacture thereof. Alternatively, the blast mitigating material lines the bottom of the container. In yet another embodiment of the present invention, the blast mitigating material is located at both the top and bottom of the container, or at both the bottom and/or sides of the container, with a lid lined with blast mitigating material.

For purposes of the present application, "enclosing devices" refers to devices which comprise a portion thereof which is hollow, such as a pipe, or a portion which is enclosed by an outer layer, such as a tire. According to the present invention, these enclosing devices can be protected from blasts by covering the enclosing area with a blast mitigating material such as BLASTWRAP™, in the case of a pipe, or by lining the enclosing area with a blast mitigating material.

One blast mitigating material, which can be used in the present invention, which is described in more detail in patent application 10/630,897, filed Jul. 31, 2003, is ideally suited to being incorporated in lids or tops of containers and/or the bottoms of containers because it is flexible and can be cut to fit exactly where needed. This material, which bears the trademark BLASTWRAP™, is made of two flexible sheets arranged one over the other and joined by a plurality of seams. The seams may be welded, stitched, hot melted together, or joined in any conventional way. The seams are arranged so as to form cells or recesses in the sheets, and the cells are recesses that are filled with a shock attenuating material, such as perlite. The assembly can be cut to the desired size along any of the seams without loss of the shock attenuating material. More importantly, because the assembly is made of flexible sheets, it can be adapted to fit snugly within a container, regardless of the shape of the container.

Containers protected according to the present invention can be used for collection (refuse cans, mail boxes), storage, transportation, and packaging for cargo or energetic material such as ammunition. Including the blast mitigating material in the top or lid and/or the bottom of the container, along with thermal insulation and fragment slowing or stopping material will prevent sympathetic detonation and protect against fast and slow cook off. This type of container protection also offers a degree of protection against a range of ballistic threats.

The top of the container can be in one or two pieces. Either the top is integral with the container and the blast mitigating material lines the top, or the top of the container is in the form of a lid which is lined with the blast mitigating material. By lining the removable top or lid with a blast mitigating material, the blast may raise the top or lid but will not raise the container.

Sympathetic detonation results when one detonating unit of energetic material initiates the next, and so on, in a chain like reaction. Sympathetic detonation is the product of an internal high-pressure event being initiated in material within the container. This high-pressure event can be caused by the impinging of a shock wave or by the impact of a primary or secondary fragment from detonating adjacent munitions. Using packaging produced according to the present invention will prevent initiation of a single unit so that one unit will not set off a chain-like reaction among the other units packaged therewith.

Fast cook off refers to the initiation of a unit of ammunition or other energetic store in the event of a flash fire such as a fuel fire. Packaging munitions or other such explosives according to the present invention will prevent the ammunition or other energetic material from reaching an auto-ignition temperature.

Slow cook-off refers to the initiation of a unit of ammunition or other energetic material in the event of a slower but more sustained thermal event. The insulating material of the present invention is also a good thermal insulator. So packaging munitions or other energetic material according to the present invention will prevent the ammunition or other energetic material from reaching an auto-ignition temperature.

Ballistic impact refers to the initiation of a unit of ammunition or other energetic material in the event of an impact by a ballistic threat such as a bullet or other high velocity projectile. Packing munitions or other energetic material according to the present invention prevents the ammunition or other energetic material from reacting in an energetic fashion.

The container and enclosing device designs of the present invention address the above issues by skillful use of suitable shock attenuating material in the lid or top of the container, or wrapped around a lining, either partially or completely, the enclosing device. The shock mitigating material that is preferably used in the present invention is flexible so that it can be wrapped inside virtually any shape, and the shock mitigating material can readily be cut to any desired size or shape. The shock mitigating material can be enhanced by incorporating fibers such as DYNEEMA® or KEVLAR® in the packaging to slow or capture casing fragments, bullets, or other ballistic threats. The use of flash suppressants and intumescent materials for protection against fast and slow cook off is also central to the packaging of the present invention.

The present invention can be used to line the lid and/or bottom of any type of container, or can be incorporated into the container under the top layer thereof. By providing a container in which the lid or top and/or the bottom is protected with a shock mitigating material such as BLASTWRAP™, the container is protected from an event inside of the container that must be contained and mitigated to protect structures, people, or other vulnerable articles outside of the container. Likewise, an enclosing device lined or wrapped with a shock mitigating material protects the enclosing device from an event that must be contained and mitigated to protect the enclosing device or people or other vulnerable structures in the vicinity.

DETAILED DESCRIPTION OF THE INVENTION

Figure 1A:
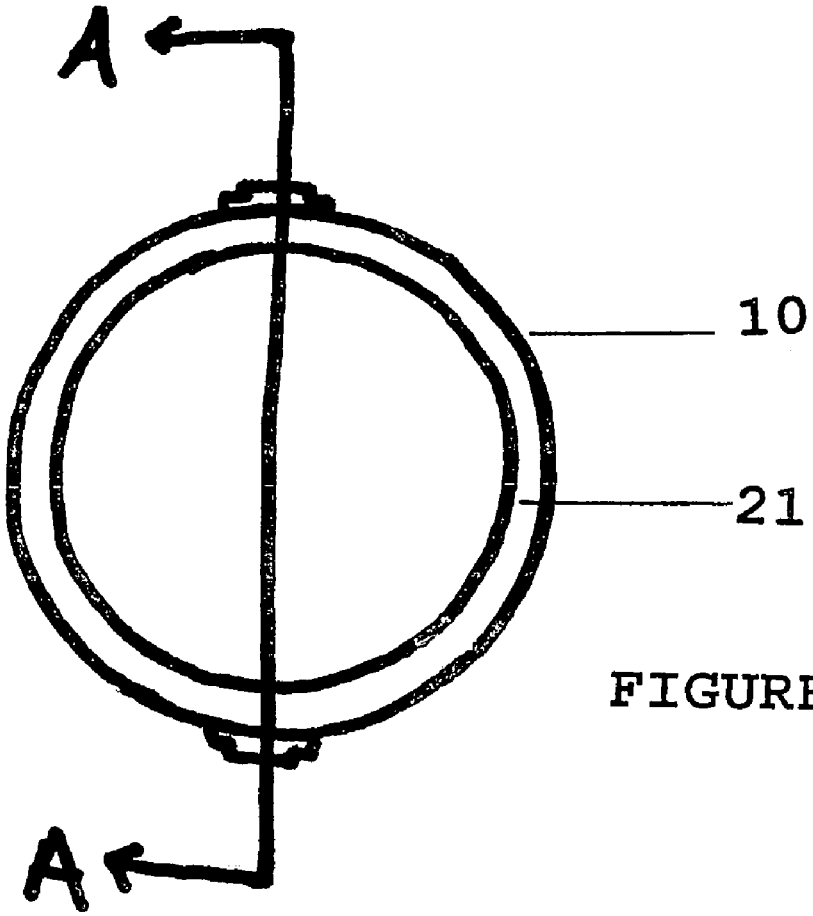
FIG. 1*a* is a top view of a trash receptacle fitted according to the present invention.

There are four distinct aspects of an explosion inside a trash receptacle, mailbox, pipe, or other such enclosing device that need to be managed effectively if members of the public in the surrounding area are not to be injured. These are:

1. primary fragmentation from the casing of the device or from materials in contact with the explosive charge
2. secondary fragmentation from the break up of the container under explosive loading or the acceleration of adjacent articles in the container.
3. air blast
4. thermal output from the fireball formed.

Any explosion mitigating container or enclosing device must stop the primary fragmentation from escaping, as this is the primary threat to the public. The container or enclosing device also must not come apart under explosive loading, which breaking apart would add to the lethality of the device. In addition to these two criteria, it is essential that the air blast, flash and fireball be effectively managed, as each can be equally lethal. A container or enclosing device that is designed merely not to come apart will funnel the blast and fireball out of the open end much like a cannon. This focusing effect can have catastrophic consequences for buildings and other structures.

Blast injuries are traditionally divided into four categories: primary, secondary, tertiary, and miscellaneous injuries. A patient may be injured by more than one of these mechanisms.

A primary blast injury is caused solely by the direct effect of blast overpressure on tissue. Air, unlike water, is easily compressible. As a result, a primary blast injury almost always affects air-filled structures such as the lungs, ears, and gastrointestinal tract.

A secondary blast injury is caused by flying objects that strike people.

A tertiary blast injury is a feature of high-energy explosions. This type of injury occurs when people fly through the air and strike other objects.

Miscellaneous blast-related injuries encompass all other injuries caused by explosions. For example, the collision of two jet airplanes into the World Trade Center created a relatively low-order pressure wave, but the resulting fire and building collapse killed thousands.

The patient's location relative to the center of the explosion is a critical factor in determining the extent and severity of the injuries sustained.

The Primary Causes of Blast Injury are as Follows:

The direct effect of blast overpressure on tissue. Since air is easily compressible by pressure while water is not, this overpressure almost always affects air-filled structures.

Pulmonary barotrauma (damage to the lungs caused by pressure), which is the most common fatal primary blast injury. This includes pulmonary contusion, systemic air embolism, and free radical-associated injuries such as thrombosis, lipoxygenation, and disseminated intravascular coagulation (DIC). Acute Respiratory Distress Syndrome (ARDS) may be a result of direct lung injury or of shock from other body injuries.

Acute gas embolism (AGE), a form of pulmonary barotrauma, requires special attention. Air emboli most commonly occlude blood vessels in the brain or spinal cord. Resulting neurological symptoms must be differentiated from the direct effect of trauma.

Intestinal barotrauma is more common in underwater explosions than air blast injuries. Although the colon usually is affected most, any portion of the GI tract may be injured.

The ear is the organ most susceptible to primary blast injury. Acoustic barotrauma commonly consists of tympanic membrane (TM) rupture, or burst eardrum. Hemotympanum (bleeding of the eardrum) without perforation also has been reported. Ossicle (a small bone in the inner ear) fracture or dislocation may occur with very high-energy explosions.

The Secondary Causes of Blast Injury are:

Injuries caused by flying objects striking individuals.

These secondary mechanisms are responsible for the majority of casualties in many explosions. For example, the glass facade of the Alfred P. Murrah Federal Building in Oklahoma City shattered into thousands of heavy glass chunks that were propelled through occupied areas of the building with devastating results.

Military explosive casings (e.g. hand grenades) are specifically designed to fragment and to maximize damage from flying debris (shrapnel).

Civilian terrorist bombers (e.g. Olympic Park in Atlanta) often deliberately place screws or other small metal objects around their weapons to increase secondary blast injuries.

The Tertiary Causes of Blast Injury

These injuries are caused by individuals flying through the air and striking other objects, generally from high-energy explosions.

Unless the explosion is of extremely high energy or focused in some way (e.g. through a door or hatch), a person with tertiary blast injury usually is very close to the explosion source.

Together with secondary blast injuries, this category accounted for most of the paediatric casualties in Oklahoma City. There was a high incidence of skull fractures (including 17 children with open brain injuries) and long-bone injuries including traumatic amputations.

Miscellaneous blast-related injuries (other injuries generated by the explosion) are caused by the following:

Toxic inhalations and exposures, radiation exposure, burns (chemical or thermal)

Asphyxiation in fires (including carbon monoxide [CO] and cyanide [CN] poisoning following incomplete combustion), and dust inhalation, including coal and asbestos exposure Crush injuries from collapsed structures and displaced heavy objects Mortality/Morbidity Mortality rates vary widely. Injury is caused both by direct blast overpressure (primary blast injury) and by a variety of associated factors.

Mortality is increased when explosions occur in closed or confined spaces (e.g. terrorist bus bombings) or under water. Land mine injuries are associated with a high risk of below- and above-the-knee amputations. Fireworks-related injuries prompt an estimated 10,000-12,000 ED visits in the United States annually, with 20-25% involving either the eye or hand.

Presence of tympanic membrane (TM) rupture indicates that a high-pressure wave (at least 6 psi or 40 kPa) was present and may correlate with more dangerous organ injury. Theoretically, at an overpressure of 15 psi or 100 kPa (the threshold for lung injury, TM routinely ruptures; however, a recent Israeli case series of 640 civilian victims of terrorist bombings contradicts traditional beliefs about a clear correlation between the presence of TM injury and coincident organ damage. Of 137 patients initially diagnosed as having isolated eardrum perforation who were well enough to be discharged, none later developed manifestations of pulmonary or intestinal blast injury. Furthermore, 18 patients with pulmonary blast injuries had no eardrum perforation.

Blast Injury Threshold

The case of ten pounds (4.54Kg) of TNT equivalence detonated inside a container will now be considered. Ten pounds of TNT liberates on detonation around 19 million Joules (MJ) of energy. This is a huge amount of energy to dissipate in a few thousandths of a second. Some trash receptacle manufacturers claim that energy is taken out of the blast by the deformation of the receptacle. Simple calculation shows that deformation of the steel bin will only account for a tiny portion of the 19 MJ available. The remainder of the energy will either be transmitted through the sides as a shock or vented out through the open end. On exiting the open mouth of the container the pressure wave will expand to equalize the pressure on either side of the shock wave and begin to spread outwards sperically. On impacting with the ground around the receptacle the blast wave will be reflected from the surface and it will establish itself as a stable, hemispherical blast wave, very similar to that generated by a ten-pound charge detonated in the air.

For a charge as large as ten pounds the effects of the bin will be negligible on the overpressure developed. Scaline of the ten pound charge gives the following estimations of pressures and physiological impact on the human body:

| Distance from Bin | Injury to 70 Kg Human |
|---|---|
| 9 feet | Severe burns |
| 17 feet | Onset of lung damage |
| 18 feet | First degree burns |
| 28 feet | All eardrums burst |
| 43 feet | Onset eardrum rupture |
| 98 feet | Completely safe |

It should be noted that these figures are for free field hemispherical blast. The possibility of injury will be significantly increased where there are complex reflections as found in the case of an explosion inside a building. The data given in the table above has been assembled from a number of different sources notably Paul Coopers "Explosive Engineering" and from the graph shown below obtained from the Journal of Mine Action Website (http://maic.jmu.edu/journal/4.2/Focus/Bass/bass.htm).

It can be seen from the data in the table that if the mitigation of the blast is not considered, an important part of the threat from an IED detonated internally in a trash receptacle has not been managed effectively.

There are many kinds of crowded environments that trash receptacles and mailboxes are deployed in and it is instructive to consider the data on blast injury given above with reference to them.

Trash receptacles are deployed in areas of high footfall, often inside structures, where the blast environment is complex and multiple reflections will form. This is probably the worst in-air scenario for blast injuries.

The answer to this conundrum may lie in the choice of charge size which can be claimed to be safely mitigated against charge sizes as large as ten pounds are simply not manageable in scenarios where people regularly approach within a few feet of the target bin. If the charge size is reduced then the possibility of managing the blast and fireball is increased. The following considers the implication reducing the charge size:

For Six Pounds TNT

| Distance from Bin | Injury to 70 Kg Human |
|---|---|
| 7.4 feet | Severe burns |
| 14.5 feet | Onset of lung damage |
| 15 feet | First degree burns |
| 24 feet | All eardrums burst |
| 36 feet | Onset eardrum rupture |
| 83 feet | Completely safe |

For Three Pounds TNT

| Distance from Bin | Injury to 70 Kg Human |
|---|---|
| 6.3 feet | Severe burns |
| 11 feet | Onset of lung damage |
| 12 feet | First degree burns |
| 19 feet | All eardrums burst |
| 29 feet | Onset eardrum rupture |
| 65 feet | Completely safe |

For One Pound TNT

| Distance from Bin | Injury to 70 Kg Human |
|---|---|
| 5 feet | Severe burns |
| 8 feet | Onset of lung damage |
| 10 feet | First degree burns |
| 13 feet | All eardrums burst |
| 20 feet | Onset eardrum rupture |
| 46 feet | Completely safe |

It can be seen that if the charge size is lowered to three pounds the damaging blast radius is reduced but not significantly and the risk of serious injury still remains. What is significant is the reduction in blast pressures inside the trash receptacle. The opportunity for energy absorption by plastic deformation of the receptacle wall and blast mitigation applied within to mitigate the blast pressure is dramatically improved. Ultimately, the effectiveness of this approach can only be quantified by testing and evaluation.

Structural damage from an internal blast is also a significant issue that must be addressed. The top of a litterbin in, for example, a train station, would be approximately 8 feet (2.46 m) from the ceiling. For a ten pound charge the roof structure will experience significantly more than 380 psi reflected blast pressure. This does not take into account the significant blast focusing effect of the receptacle. Pressures of this magnitude will almost certainly cause catastrophic failure of the structure. As discussed in much of the literature on blast, the majority of fatalities are not caused by the direct effects of the blast wave on the human body but by the catastrophic failure of the structure that the victims occupy or by the violent translation caused to them. This was tragically illustrated by the bombing of Alfred P Murrah Building in Oklahoma City.

Without going into detail in this note, it is worth pointing out that many buildings are extremely vulnerable to blast and catastrophic failure can result from a relatively minor explosive event.

There are three accepted methods of effectively managing internal explosive blasts: total containment, controlled venting and blast mitigation.

With a total containment system the explosion would be contained within an extremely strong sealed system, usually a steel cylinder or sphere fitted with a blast proof door. This kind of system is associated with a significant cost and mass penalty, and as they will have to be closed to be effective they are of virtually no use as a trash receptacle.

Controlled venting utilizes the strong containment approach but manages the quasi-static pressure within the container by venting the highly pressurized hot gases out through vents of a carefully designed size. This system will have mass and cost issues and the vent size is unlikely to be appropriate for passing trash through.

Blast mitigation is an effective approach. Blast mitigants such as BlastWrap™ have been shown to reduce blast overpressure by as much as 97% with distance and are regularly used in reducing the effects of explosions. However, even allowing for such significant blast attenuation, in the case of a twelve-pound charge, approximately 8 feet of mitigation will be required to reduce the blast attenuation to a degree that could be considered safe for the general public.

The driving factor in the endeavor to develop a trash receptacle or other container or enclosing device that can protect the public from the devastating effects of a terrorist bomb is not whether the receptacle stays together under explosive loading but how the blast and fireball can be reduced to levels that are no longer a significant threat. This being the case, the strength of the trash receptacle can be reduced and, if ultimate receptacle strength is reduced, then there is a corollary reduction in mass and cost of the bin. This also is true for enclosing devices.

One further point on receptacle design: some material, such as many composites, fail safe in that they tend to split down one side under excessive loading and do not fragment, whereas some materials such as steel fail in a much more dangerous fashion which will ultimately produce lethal fragmentation.

Unfortunately, there are currently no official (US) standards for vendors to comply with when developing bomb resistant waste bins or either such containers or enclosing devices. There are also no restrictions placed on buyers when purchasing this technology. This makes it important to ask the right questions and exercise good judgment when purchasing and deploying a technology of this nature.

This is very true and is very good advice that the explosion resistant trash receptacle manufacturing industry needs to take to heart. There are, however, standards that exist in the other countries that define the method and threat for testing explosive proof bins (notably "Specification for Explosive Testing of Litter Bins" by Dr R Lacey, M J Pettit of, the UK Police Scientific Development Bureau). The details of how to obtain this report can be found at the Home Office website at the following link:

http://www.homeoffice.gov.uk/crimpol/police/scidev/publications.html

It is believed that the standard threats suggested within this note are a plastic explosive charge surrounded by various trash items and steel balls to represent "worse case" fragmentation. The mass of the charge is defined by the trash receptacle manufacturer and indicates the level that the unit is tested safe to. For the US it is suggested that 2.2 lb (1 Kg) bare charge of TNT and a steel pipe bomb filled with 0.55 lb (250 g) smokeless powder are a credible place to start in terms of threat as these are commonly seen throughout the world.

A blast proofed bin must be able to withstand an internal blast from a 2.2 pound bare TNT charge detonated in three positions within the receptacle; center, side and bottom. The bin must remain intact and produce no secondary fragmentation, and it must not in, any way, increase the hazard from the explosive device. The bin must stop all of the fragmentation from a steel pipe bomb filled with 250g smokeless powder or a standard military issue hand grenade, whichever is found to be the more severe threat. Blast pressures must be lower than potentially lethal beyond three feet from the edge of the bin. Flash and fireball must be contained within the bin.

Chemical Explosives: Types, Characteristics, etc.

Chemical Explosive—A compound or mixture which, upon the application of heat or shock, decomposes or rearranges with extreme rapidity, yielding much gas and heat. Many substances not ordinarily classed as explosives may do one, or even two, of these things. For example, a mixture of nitrogen and oxygen can be made to react with great rapidity and yield the gaseous product nitric oxide; yet the mixture is not an explosive since it does not evolve heat, but rather absorbs heat. For a chemical to be an explosive, it must exhibit all of the following:

1. Formation of Gases—Gases may be evolved from substances in a variety of ways. When wood or coal is burned in the atmosphere, the carbon and hydrogen in the fuel combine with the oxygen in the atmosphere to form carbon dioxide and steam, together with flame and smoke. When the wood or coal is pulverized, so that the total surface in contact with the oxygen is increased, and burned in a furnace or forge where more air can be supplied, the burning can be made more rapid and the combustion more complete. When the wood or coal is immersed in liquid oxygen or suspended in air in the form of dust, the burning takes place with explosive violence. In each case, the same action occurs: a burning combustible forms a gas.
2. Evolution of Heat—The generation of heat in large quantities accompanies every explosive chemical reaction. It is this rapid liberation of heat that causes the gaseous products of reaction to expand and generate high pressures. This rapid generation of high pressures of the released gas constitutes the explosion. It should be noted that the liberation of heat with insufficient rapidity would not cause an explosion. For example, although a pound of coal yields five times as much heat as a pound of nitroglycerin, the coal cannot be used as an explosive because the rate at which it yields this heat is quite slow.
3. Rapidity of Reaction—Rapidity of reaction distinguishes the explosive reaction from an ordinary combustion reaction by the great speed with which it takes place. Unless the reaction occurs rapidly, the thermally expanded gases will be dissipated in the medium, and there will be no explosion. Again, consider a wood or coal fire. As the fire burns, there is the evolution of heat and the formation of gases, but neither is liberated rapidly enough to cause an explosion.
4. Initiation of Reaction—A reaction must be capable of being initiated by the application of shock or heat to a small portion of the mass of the explosive material. A material in which the first three factors exist cannot be accepted as an explosive unless the reaction can be made to occur when desired.

TYPES OF EXPLOSIONS: Explosives are distinguished between high explosives, which detonate, and low explosives, which deflagrate.

Pressure Burst—If a liquid is sealed in a container and heated, the liquid will vaporize and pressurize the container. If this process is continued, the pressure will rise until it exceeds the strength of the container and the container will burst. The pressurized gas will then escape. The higher pressures traveling faster than the lower pressures will result in a blast wave with a calculable TNT equivalence.

Low Order Explosion—Low explosives change into gases by burning or combustion. These are characterized by deflagration (burning rapidly without generating a high pressure wave) and a lower reaction rate than high explosives. The overall effect ranges from rapid combustion to a low order detonation (generally less than 2,000 meters per second). Since they burn through deflagration rather than a detonation wave, they are usually a mixture, and are initiated by heat and require confinement to create an explosion. Gun powder (black powder) is the only common example.

Deflagration—The chemical decomposition (burning) of a material in which the reaction front advances into the reacted material at less than sonic velocity. Deflagration can be a very rapid combustion which, under confinement, can result in an explosion, although generally it implies the burning of a substance with self-contained oxygen. The reaction zone advances into the unreacted material at less than the velocity of sound in the material. In this case, heat is transferred from the reacted to the unreacted material by conduction and convection. The burning rate for a deflagration is usually less than 2,000 meters/second.

Fuel/Air Explosion—High explosive materials contain the oxygen that they require for detonation within their chemical structure. A fuel/air explosion occurs when a chemical, which on its own will not detonate, is mixed with ambient air and is initiated by an event of the appropriate energy. The air provides the oxygen that is required to maintain the detonation oxygen balance. Fuel/air explosions are characterized by their power, which can be orders of magnitude higher than TNT. An example of this kind of explosion is the propylene oxide/air reaction.

Detonation—Also called an initiation sequence or a firing train, this is the sequence of events which cascade from relatively low levels of energy to cause a chain reaction to initiate the final explosive material or main charge. They can be either low or high explosive trains. It is a chemical reaction that moves through an explosive material at a velocity greater than the speed of sound in the material. A detonation is a chemical reaction given by an explosive substance in which a shock wave is formed. High temperature and pressure gradients are generated in the wave front, so that the chemical reaction is initiated instantaneously. Detonation velocities lie in the approximate range of 1,400 to 9,000 m/s or 5,000 to 30,000 ft/s.

High Order Explosion—High explosives are capable of detonating and are used in military ordinance, blasting and mining, etc. These have a very high rate of reaction, high-pressure development, and the presence of a detonation wave that moves faster than the speed of sound (1,400 to 9,000 meters per second). Without confinement, they are compounds that are initiated by shock or heat and have high brisance (the shattering effect of an explosion). Examples include primary explosives such as nitroglycerin that can detonate with little stimulus and secondary explosives such as dynamite (trinitrotoluene, TNT) that require a strong shock (from a detonator such as a blasting cap).

EXPLOSION SENSITIVITY: Explosives are classified by their sensitivity, which is the amount of energy to initiate the reaction. This energy can be anything, from a shock, an impact, a friction, an electrical discharge, or the detonation of another explosive. There are two basic divisions on sensitivity:

Primary Explosives—They are extremely sensitive to shock, friction, and heat and require a small quantity of energy to be initiated. They are mainly used in detonators to initiate secondary explosives.

Secondary Explosives—They are relatively insensitive to shock, friction and heat and need a great amount of energy to initiate decomposition. They have much more power than primary explosives and are used in demolition. They require a detonator to explode.

Impact—Sensitivity is expressed in terms of the distance through which a standard weight must be dropped to cause the material to explode.

Friction—Sensitivity is expressed in terms of what occurs when a weighted pendulum scrapes across the material (snaps, crackles, ignites, and/or explodes).

Heat—Sensitivity is expressed in terms of the temperature at which flashing or explosion of the material occurs.

Explosion Characteristics

Pressure—When a force acts perpendicular to a surface, the pressure (p) exerted is the ratio between the magnitude of the force and the area of the surface: pressure=force/area, and may well be expressed using other terms such as bars, atmospheres or dynes. Pressure is used to characterize one of the main parameters, sometimes known as the intensity of the blast wave.

Overpressure—The pressure measured above the ambient pressure at the time of measurement.

Shock—A shock front is a virtual discontinuity in the physical properties of the gas through which it is passing. The shock thickness is of the order of ten mean free paths, which for a gas at standard temperature and pressure is approximately 100 nm or close to the wavelength of light. This discontinuity is characterized by a near instantaneous rise in pressure. The velocity of the shock, or Mach number, is dependent on the magnitude of the pressure.

Air Blast—The airborne shock wave or acoustic transient generated by an explosion that has the characteristics of overpressure, duration and impulse.

Impulse—The product of average net force and change in time. It can be measured in Newton×Seconds (Ns) and is equal to (causes) the exchange in momentum between the explosive charge and the target. It is the integral of the positive portion of the pressure/time history (unless stated otherwise). Structures are generally more sensitive to the effects of impulse rather than peak pressure. This is due to the quarter wavelength of the natural frequency of the many structures of interest being longer than the duration of the blast wave.

Quasi-Static Pressure—A process taking place relatively slowly so that all the intensive variables can have definite values through the entire path taken by the process. Such a process is called a quasi-static process. Quasi-static pressure occurs in situations where the duration of a pressure event from the liberation of gas and/or heat from an explosive event is significantly longer than the response time of the structure. The loading can be treated like a static or quasi-static event. This is a common phenomenon for internal explosions in poorly vented structures.

Explosion Phenomena

Flash—Light and infrared emissions generated by an explosion are generally known as the "flash". The flash can cause severe burns close to the source of the blast. Some energetic material liberates a significant proportion of its energy as radiated heat with reduced blast, like Magnesium/Teflon/Viton. Most explosive materials generate flash unless they have been specifically developed not to do so such as "permitted" explosives used in the mining industry.

Afterburn—Post-detonation, aerobic combustion of fuel rich species as detonation products mix with the surrounding air. Some explosive materials are not oxygen balanced and produce fuel rich detonation products. The burning of these products increases flash and will produce quasi-static pressure, if confined. After burn is a significant issue for confined explosions and can initiate post-blast fires.

Fragmentation—The breaking and scattering in all directions of the pieces of a projectile, bomb or grenade or the breaking of a solid mass into pieces by blasting. Fragments generated by a cased explosion can have a very high velocity (>2500 ms) and are potentially lethal at long distances from the site of the explosion. This is one of the dominant threats to personnel from a cased explosion. Fragmentation can be difficult to effectively deal with and requires a high mass solution or expensive lightweight ballistic protection.

Secondary Fragmentation—Material close to the explosion can be propelled by the blast and projected some distance from the event. This material is potentially lethal. It is essential in any mitigation system that secondary fragmentation is effectively managed or reduced to an absolute minimum.

Collateral Damage—(Euphemism) Inadvertent casualties and destruction inflicted on material or civilians in the course of military operations as well as unintended damage to materials surrounding a controlled explosion. Collateral damage reduction is the mitigation of the damage from a controlled explosion.

Ground Shock—Shaking of the ground by elastic waves emanating from a blast: usually measured in inches per second of particle velocity, where the charge is close to, or in contact with the ground. Low frequency ground shock can produce significant damage to structures at large distances from the site of the explosion. Ground shocks can become enhanced by reflections from varying density layers deep in the earth.

Mitigation Mechanisms

Irreversible Changes—The laws of conservation of mass, momentum and energy for a shock wave imply that it is difficult to reduce explosive effects rapidly. The energy of the explosion must be dissipated through irreversible processes such as drag, turbulence, friction and viscosity. With BlastWrap™, this is achieved, in part, through crushing of porous media and entrainment into a two-phase flow.

Two Phase Flow—The flow of two mixed materials of different phases (i.e., particulate in gas, liquid droplets in gas, gas in liquid, particulate in liquid, etc.). Energy dissipation occurs in a two-phase flow through viscose drag and is a critical mitigation mechanism for BlastWrap.

Momentum Exchange—Momentum in mechanics is the quantity of motion of a body. The linear momentum of a body is the product of its mass and velocity. The effective management of momentum exchange is an important mechanism in blast mitigation. On detonation, the momentum of the blast wind and detonation products are transferred to the surrounding media (BlastWrap™) which in turn is entrained into a two-phase flow. This mechanism allows energy to be dissipated through viscose drag. Structural coupling is the negative aspect of this mechanism.

Shock Multipathing—The speed of sound for any material is given by: $a^2=Be/p$, where "a" is acoustic velocity, "Be" is the bulk modulus of elasticity and "p" is the density. The implication of this is that shocks travel at differing velocities in different materials. In a material containing two phases, this causes the shock front to be "smeared" and spread out over time due to the differential in the acoustic velocities of the two materials.

Flash Suppression—It is possible to reduce the flash output of an explosive device by reducing the afterburning of the detonation products in air. This can be accomplished by quenching the event or by interfering in the combustion process. Quenching is achieved by the rapid liberation of water into the fireball or the combustion processes can be disrupted by the use of advanced fire suppression materials.

Fire Extinguishing—Fire requires four criteria in order to develop: fuel, oxygen, heat and time. If any one of the four criteria is prevented from participating in the combustion, then the fire is extinguished. In an explosive event, the process of extinguishing must take place extremely rapidly (<50 ms) if it is to be effective. Ideally, materials that break down into flame extinguishing components in less than 1 ms should be intimately mixed with the accelerating flame front.

Shock Decoupling—A shock propagates with a given speed, pressure, and particle velocity relative to the shock impedance of the material through which it is propagating. At the interface with a material of different shock impedance, the laws of conservation of momentum energy and mass are obeyed and the shock is transmitted with little or no loss. If a shock attenuant is introduced between the two materials and the transmitted shock is significantly reduced, the assembly is said to be shock decoupled.

While it is known that if an explosive charge is surrounded with any type of dense material (for the purpose of this application, materials having a density of 1 gram/cc or more), there is a reduction of blast over pressure generated by an explosive source. This is due to the energy of the explosion being partitioned between the blast wave in air and the shock propagating in the dense material surrounding the explosive charge. The disadvantage of using dense materials for blast mitigation is that the energy and momentum are conserved and the material is moved away from the site of the explosion at considerable velocity, thus doing damage at a distance remote from the origin of the blast. This increases the potential damage of the explosion. Reduction in blast pressure, however, is only part of the problem of explosion mitigation. The materials used in the present invention have been chosen for their properties that offer excellent blast pressure reduction properties while conserving little of the explosive energy as momentum. This is achieved by harnessing irreversible processes within the material.

The present invention solves the problem of containing a blast in a container such as a mailbox or trash receptacle by providing a blast mitigating lining in the top of the container and/or around the bottom of the container.

Figure 1B:
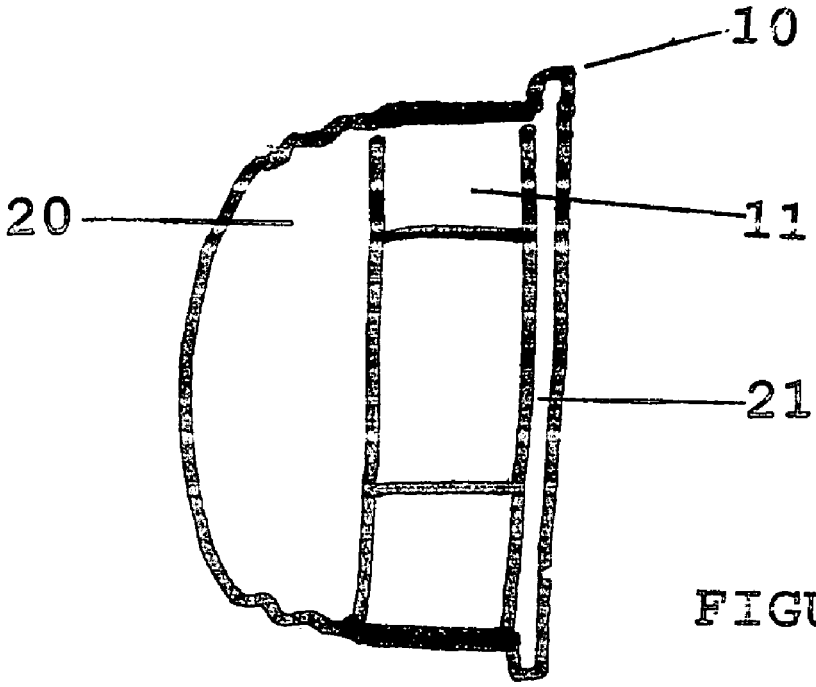
FIG. 1*b* is a side view of the top of a trash receptacle fitted according to the present invention.

FIG. 1*a* shows the inside of a lid 10 of a container which has been fitted with BLASTWRAP™ 11. FIG. 1*b* shows a side view of the lid taken along line A-A. The BLASTWRAP 11 lines the inside of the lid around the bottom of the side of the lid. The top of the lid 10 may take any shape, and may include a top ring 20 and a bottom pan 21. However, a convex top provides more blast mitigation in the center of the top, and is particularly well adapted for containers to be placed outside so that rain can fall away properly.

Figure 2:
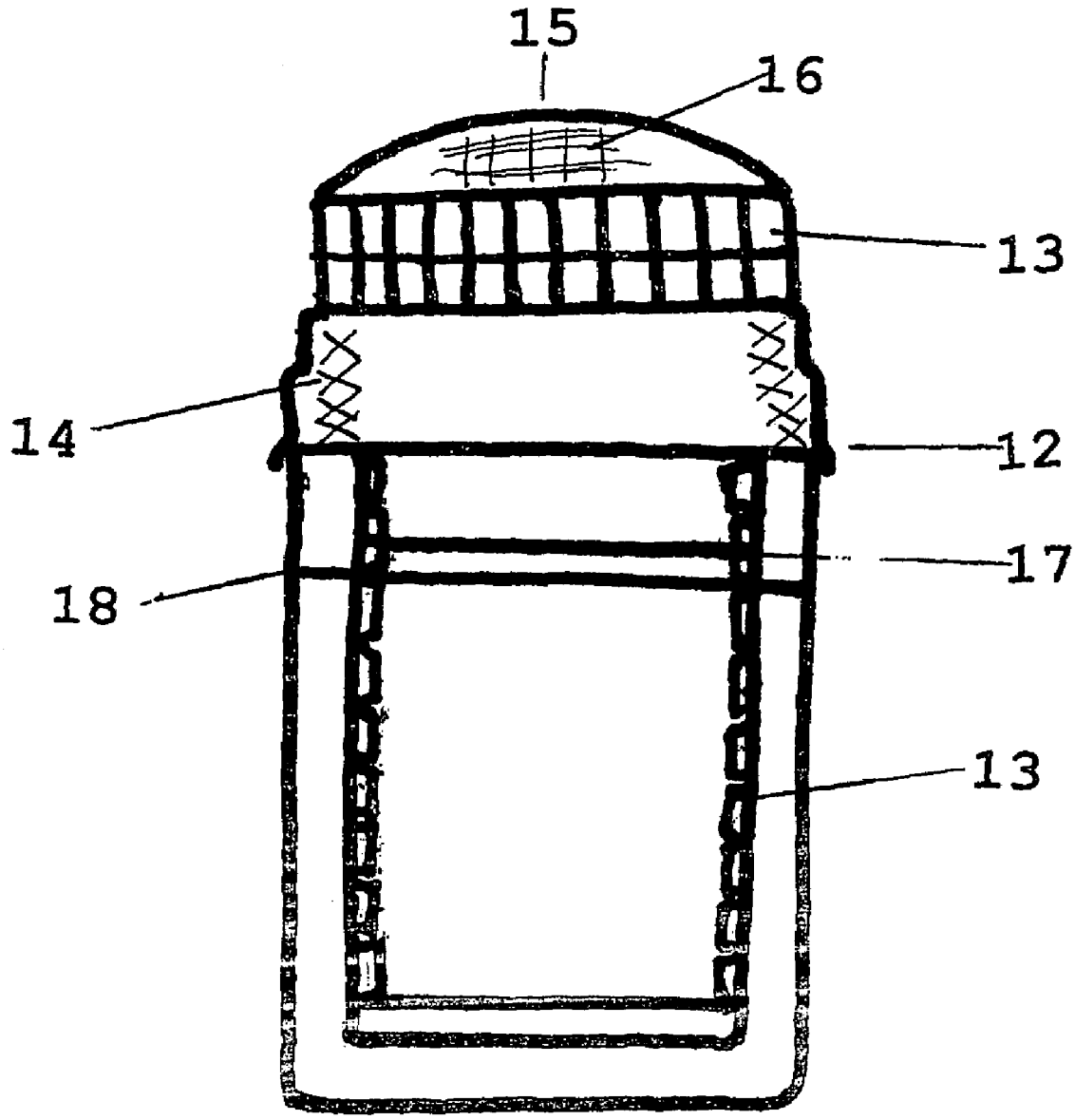
FIG. 2 is a side view of an entire trash receptacle fitted according to the present invention.

FIG. 2 shows a view of a container 12 taken along line A-A of FIG. 1 in which the inside of the container as well as the lid is lined with BLASTWRAP™ 13. BLASTWRAP™ 13 can also line the inside of the cover as well as the inner top of the lid. The filled pockets here are shown as squares, but the filled pockets can be any convenient shape, including circles, ovals, rectangles, etc.

For example, a trash container approximately 31 inches wide at the bottom and approximately 16 inches high can be protected with BLASTWRAP™ by lining the bottom circumference of the trash container with BLASTWRAP™ which is wrapped around approximately the bottom 10 inches of the side of the trash container. The top of the trash container can be lined with about six inches of BLASTWRAP™.

Figure 3:
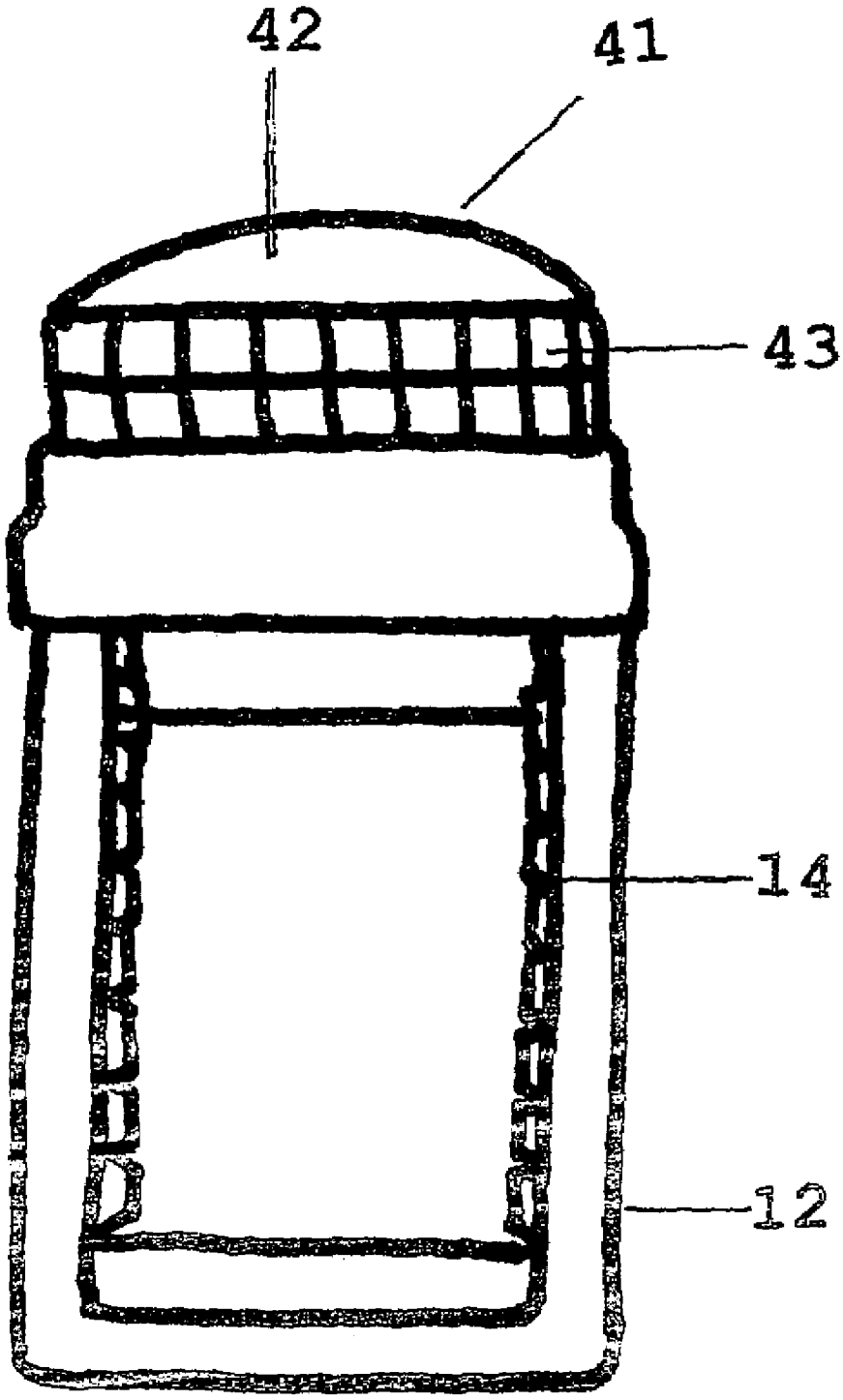
FIG. 3 is a side view of another embodiment of a trash receptacle fitted according to the present invention.
Figure 4:
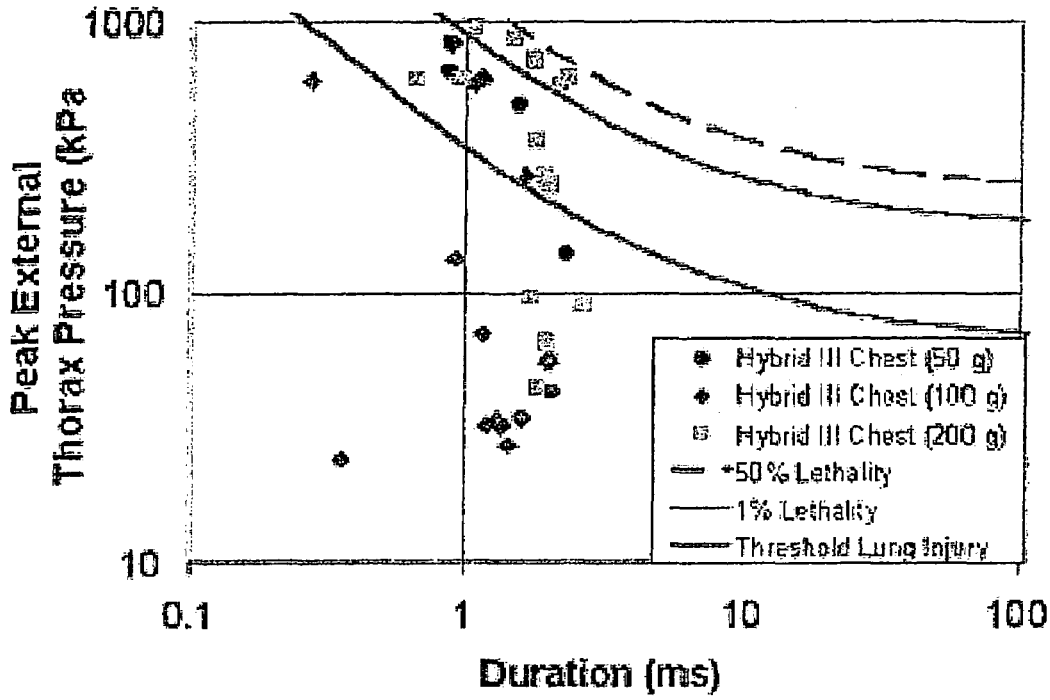
FIG. 4 shows pressure/duration data for the onset of blast injury.
Figure 5:
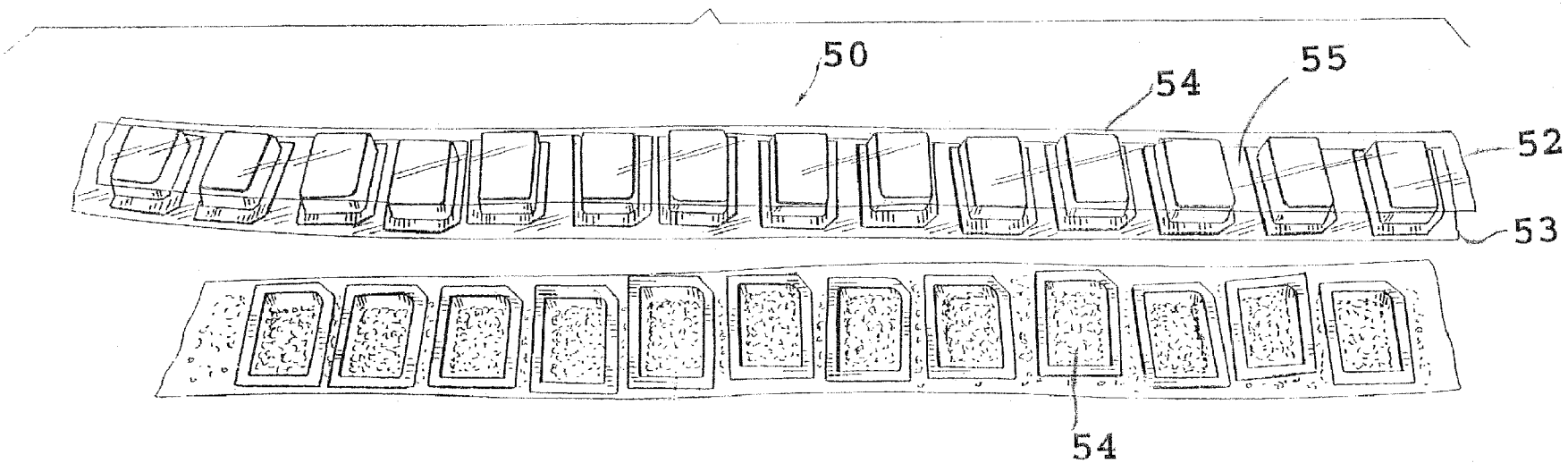
FIG. 5 shows the configuration of BLASTWRAP® shock attenuating material.

FIG. 3 shows an alternative lining 14 for a container 12. The container includes a frangible cap 42 covered by a blast mitigating material 43. In an explosion, the top disengages and, because it is frangible, breaks into pieces that are not dangerous to people in the vicinity of the explosion.

In an embodiment illustrated in FIG. 2, the top of the cover 14 is lined with six inches of BLASTWRAP™. Above this is a space of about two inches that can also be filled with BLASTWRAP™.

In another embodiment, the top dome 16 can be lowered by one inch or more. Reduction of this area would slightly lower the center of gravity and provide additional BLASTWRAP™ for the rest of the top. However, this means that less BLASTWRAP™ is available above the locus of the explosion.

In another embodiment, the cover can have an opening 16 at the top of the container. This opening serves as inlet for the trash into the container. A deflector chute can be incorporated in the opening 16 in order to slow rain from entering the can as well as act as a guide for the trash entering the top can opening and down into the can liner. A n encroachment/interference 17 is located below the doughnut ring 18 in the trash can. Additional BLASTWRAP™ can be located at this point, or the entire inner liner of BLASTWRAP™ can be lowered to the inner liner of BLASTWRAP™ in the can.

The large bottom container is optionally equipped with a handle to allow lifting of the container for cleaning. This handle can be in the form of a rope with a piece of hose over it.

While any type of blast mitigating material can be used to protect containers and enclosing devices according to the present invention, the preferred material is BLASTWRAP™, or any of the blast mitigating material described in Waddell et al., U.S. Ser. No. 10/630,897, filed Jul. 31, 2003, the entire contents of which are hereby incorporated by reference, which materials have the advantage of being sufficiently flexible to enable them to line any shape container or container lid. However, other suitable materials can be used, which are preferably lightweight materials that also possess excellent thermal insulation and fire suppression properties.

The following is a list of blast-mitigating material that can be incorporated between flexible sheets to form blast-mitigating assemblies for use in the present invention. This list is by way of illustration only, and is not intended to be an exhaustive list. One skilled in the art can, without undue experimentation, add many other suitable materials to this list.

Perlite
Vermiculite
Pumice in all forms
Aqueous foams
Aerogels
Syntactic foam

Any porous, crushable material that rapidly reduces shock pressures with distance Any material that exhibits shock attenuation and thus blast-mitigation properties by virtue of two-phase flow.

A number of different types of materials can be used with shock or blast-attenuating materials to enhance their effectiveness, particularly with respect to stopping fragments. A list of such materials is as follows:

Fragment Stopping Materials
- Foamed aluminum
- Foamed steel
- Foamed titanium
- Aluminum armor plate
- Steel armor plate
- Aramide fiber such as KEVLAR® or TWARON®
- Polyethylene fiber such as DYNEEMA® or SPECTRA®
- Polybenzobisoxazoles such as ZYLON®, a high-performance fiber developed by TOYOBO comprising rigid-rod chain molecules of poly (p-phenylene-2,6-benzobisoxazole)
- G-LAM® nano-fiber
- Ballistic nylon
- Extremely hard material such as ceramic and boron carbide
- Glass fiber
- PYROK® and other dense, cement based fiber boards Flash and Fire Suppressants
- Chlorinated compounds
- Brominated compounds
- Phosphorus containing compounds
- Metal hydroxides
- Alkali metal compounds, including but not limited to sodium bicarbonate, potassium bicarbonate, sodium carbonate and potassium bicarbonate
- Iron pentacarbonyl
- Melamine® based materials
- Borates such as zinc borate
- Low melting point glasses
- Material that generate smothering gaseous products such as bicarbonates, carbonates, and sodium tetrachlorate Fire and Thermal Barriers
- Silicon based additives
- Borates such as zinc borate
- Inorganic alumino-silicate resins
- Nano-composites
- Expandable graphite
- MELAMINE® based materials
- Ammonium polycarbonates
- Polyurethane foam
- Phosphorus containing compounds
- Intumescent paints, intumescent coated fabrics, and other intumescent barriers
- Endothermic mats and wraps
- Silicon RTV foams
- Fireproof resins and polymers In a preferred embodiment of the present invention, the blast-mitigating material incorporated between flexible sheets is perlite, more preferably in combination with a fusible salt, such as borax pentahydrate, borax decahydrate, boric acid, alumina trihydrate, and calcium hydroxide. One skilled in the art can readily ascertain which fusible salts can be used to provide fire resistance/retardance in combination with the perlite.

The most preferred combination of blast-mitigating material incorporated between flexible sheets is a combination of powdered perlite and boric acid. This combination, as well as combination of perlite with other fusible salts, within 2 milliseconds quenches the fireball produced by an explosion and prevents post-blast fires.

Powdered perlite is denser material than conventionally available perlite, as powdered perlite is perlite that has been crushed to form a powder. One example of this is Perlite-P60, which has conventionally been used for filtration. This denser material slows down fragments and increases blast mitigation. By using P60 perlite rather than horticultural grade or expanded perlite, the volume of the insulation can be reduced while not sacrificing blast mitigation properties. For example, three inches of P60 perlite is the equivalent of abut 5 to 6 inches of conventional horticultural perlite.

Any type of container can be protected according to the present invention, including but not limited to rubbish bins, trash receptacles, mailboxes, mail storage containers, including enclosing devices, and the like. The blast mitigation materials can be such that the container or enclosing device is protected from all types of pressure wages, both acoustic and shock waves, in all gaseous environments, particularly in ambient atmospheric conditions. The blast-mitigated containers protect the public and buildings and other structures from explosions within the containers by mitigating the effects of the explosions.

Experimental

A series of tests were conducted at a firing range in California to investigate the effectiveness of BLAST-WRAP™ in mitigating air blast and fireballs from high explosive charges. Trials were conducted against a range of fiberglass cylinders and rings, oil pipelines and trash receptacles. High quality pressure data were recorded to evaluate the performance of the various systems in terms of physiological damage to the human body. Video records were also made to monitor the development and propagation of the fireball and to determine the effectiveness of BLAST-WRAP™ in extinguishing the fireball.

Instrumentation

Two channels of instrumentation were used. The pressure transducers were PCB Model 113A21 (High Frequency ICP® pressure probe, 200 psi, 25 mV, 0.218 inch diameter diaphragm, acceleration compensated), piezoelectric type with built in charge amplifier with the following specifications:

Sensitivity: (±15%) 25 mV/psi (3.6 mV/kPa)
Low Frequency Response: (0.5%) 0.5 Hz
Resonant Frequency≧500 kHz
Electrical connector: 10-32 Coaxial jack
Weight (with clamp): 0.21 oz (6.0 g)

The poser unit and amplifier were PCB Model 480D06 with three grain settings ×1, ×10 and ×100. The pressure time histories were recorded onto a standard PC laptop using Adobe Audition software through an Edirol UA-1X USB audio interface. All records were 16 bit and captured at a 44.1 kHz sampling rate. The system was calibrated using a laboratory standard voltage supply and digital voltmeter.

Blast pressures were calculated using the blast scaling laws tabulated in the curves in TN 5-885-1, "The Fundamentals of Design for Conventional Weapons." Previous research has demonstrated that these curves are as accurate as any for medium sized charges in the middle distance. The TNT equivalent for C4 in terms of pressure in TM-5-855-1 is given at 1.37, which is higher than often taken but appears to fit will with the data in the experiments reported herein.

There are two modes in which blast pressures are conventionally measured:

Free field spherical air blast

Hemispherical reflected blast

Free field spherical air blast is captured within a charge is fired high above the ground and is not close to any reflecting surface. Hemispherical reflected blast is captured when the charge is in contact with, or close to, the ground or other reflecting surface. The measured pressure for hemispherical blast can be twice that of free-filed pressure, although it is usually taken to be about 1.8 times greater.

As an illustration, the spherical free-fired pressure for one pound of TNT at 15 feet is 3.4 psi, but rises to 4.7 psi for a hemispherical blast. While this is not the full 1.8 magnification factor that is usually used, but still an increase.

In the experiments described herein, it was not possible to raise the trash receptacles, etc. 30 feet off the desert floor, and given that the charges were fired approximately 18 inches above the ground, the blast was neither spherical free field nor hemispherical reflected in nature. Consequently, the blast pressure records captured lie somewhere between the two extremes.

The pressures for smaller charges were calculated as free field spherical blast waves, not in the hemispherical mode. This is because the desert floor was relatively soft, and consisted of loose packed sand, which is far from an ideal reflective surface off hemispherical measurement. It is considered, however, that as the charge size rises and the intensity of the blast increases that the blast wave approaches a hemispherical mode.

An absolute value for pressure was not obtained in the experiments described herein, as the experiments were designed to compare the effects of blasts with blast mitigating materials.

The materials used for testing were as follows:

Nine 24 inch diameter, 14 inches high fiber glass first responder rings in three thicknesses: 0.5 inches, 0.625 inches, and 0.75 inches.

Twelve 36 inch diameter by 36 inches high glass fiber cylinders in four thicknesses: 0.5 inch, 0.75 inch, 1.5 inches and 2.5 inches 100 meters of Fraglite anti-ballistic cloth One 4 feet by 4 feet multi-ply KEVLAR® blanket One American Innovations Trash receptacle Three 7 feet long sections of 24 inches diameter oil pipeline Several containers of BLASTWRAP of various sizes The following explosive materials were used in the experiments:

C4

Smokeless powder

Blasting caps burning fuse

The fiberglass cylinders were custom made for these experiments and were laid up by hand using a fiberglass mat and Ashland Hetron 922 vinyl ester resin. The choice of materials was made on the requirement for fragment stopping. The base of the cylinder was filled to a depth of 6 inches with concrete and tied in by the inclusion of three 0.5-inch diameter steel rebars. The concrete base was included to ensure that the pressure and fireball did not vent via the base, as well as to provide a realistic surface from which the blast wave could reflect, which increases the internal stresses on the cylinder.

The first responder rings were made to the same specification as the cylinder, but they were not fitted with a concrete base.

The oil pipes used in the tests described below were second hand sections of oil pipelines. The wall thickness of the pipe was ⅜ inch, and the tubes were capped at the ends with ⅜ inch steel plates, welded into place. The entire assembly was filled with water. Filling the tube with liquid replicates the oil filling in a pipeline and makes the wall significantly harder to breach.

A total of 24 tests were conducted over a two-day period.

Test 1

A charge of 0.72-pound Cr calculated to have a TNT equivalence of one pound TNT was prepared and placed centrally in a 36 inches internal diameter by 36 inches high fiberglass cylinder. The cylinder had a wall thickness of 2.5 inches, and the charge was suspended centrally inside the cylinder 18 inches above the desert floor. There was no concrete base in this cylinder. The pressures for this charge were calculated as a bare charge in air at 15 feet, and were expected to be approximately 3.9 psi. No BLASTWRAP™ was applied to this cylinder.

After setting the charge, the fiberglass cylinder remained intact, with no discernible damage.

Test 2

This was identical to Test 1 except that three inches of BLASTWRAP™ was applied to the internal diameter and the base of the cylinder for this shot.

The fiberglass cylinder remained intact, with no discernible damage.

Test 3

This shot was identical to Tests 1 and 2 except that, along with three inches of BLASTWRAP™ applied to the internal diameter and the base, a three inches thick BLASTWRAP™ top was added.

The fiberglass cylinder remained intact with no discernible damage.

Test 4

This test was identical to the previous three tests except that the only blast mitigation applied was three inches of BLASTWRAP™ applied as a top.

The fiber class cylinder remained intact, with no discernible damage.

Test 5

This test was identical to the previous four tests except that three inches of BLASTWRAP™ was applied as an internal liner to the base and top. The charge weight was increased to the equivalent of 5 pounds of TNT.

There was no discernible damage to the cylinder.

Test 6

This shot was identical to Test 5, except that there was not BLASTWRAP™ . The charge was equivalent to 5 pounds of TNT.

There was no discernible damage to the cylinder.

Test 7

This test was identical to Test 6 except that three inches of BLASTWRAP™ was applied as an internal liner, base and top. The charge weight was increased to the equivalent of 10 pounds of TNT.

There was no discernible damage to the cylinder.

Test 8

This shot was identical to that of Test 7 except that there was no BLASTWRAP™ applied. The charge was the equivalent of 10 pounds of TNT This fiberglass cylinder was the same one used for Test 1 and had experienced eight detonations with no discernible damage. These shots include two 5 pound and two 10 pound TNT equivalents.

Test 9

This shot was a calibration blast to provide a check on the instrumentation. The charge was equivalent to 1 pound TNT and was positioned on a post two feet above the ground No BLASTWRAP™ was applied. Pressures were measured at 15 feet. As previously discussed, there is potential difficulty with predicting the pressure for this type of shot, the charge set up is not conducive to measuring either hemispherical or spherical blast. There are two reasons for this: examination of the pressure time histories show the results to lie about halfway between the two extremes as expected. Importantly, the pressure time histories are both nearly Friedlander in shape, showing little evidence of reduction at 15 feet, although a small reflection can be seen at around 0.0193s). These blast records show that the instrumentation system was collecting data accurately within the limits of the experimental setup.

Test 10

A 1.44-pound C4 charge, calculated to be equivalent to 2 pounds of TNT, was prepared and placed centrally in a 35 inches internal diameter by 36 inches high fiberglass cylinder. The cylinder had a wall thickness of 0.5 inch, and the charge was suspended 12 inches above the concrete base of the cylinder. The pressures for this charge, calculated as a bare charge in air at 15 feet, were expected to be approximately 6 psi. No BLASTWRAP™ was applied to this shot.

The fiberglass cylinder was broken into pieces, although the throw of the pieces was limited to about ten feet.

Test 11

A 0.72-pound C4 charge, calculated to be equivalent to 1 pound of TNT, was prepared and placed centrally in a 36 inches internal diameter by 35 inches high fiberglass cylinder. The cylinder had a wall thickness of 0.5 inch, and the charge was suspended 12 inches above the concrete base of the cylinder. The pressures for this charge, calculated as a bare charge in air at 15 feet, were expected to be approximately 63.9 psi. No BLASTWRAP™ was applied to this shot.

The fiberglass cylinder remained intact, with no discernible damage.

Test 12

The charge fired in this test was a 12 inches long section of steel water pipe having an internal diameter of 2 inches. The ends of the pipe were threaded, and standard water fitting end caps were attached. The pipe have been filled with ½ pound Hercules Green Dot smokeless powder. One of the end caps had been dried to form a ¼ inch diameter hole through which a detonator was inserted to initiate the device.

The charge was fired in the remains of the fiberglass cylinder from Test 10, positioned within a large steel plate lined pit. The remains of the tube were used, as there were a limited number of 0.5 inch thick cylinders available, and large areas of the cylinder remained undamaged, and made useful fragmentation witness plates.

The tube appeared to have stopped most if not all of the fragmentation from the main body of the pipe bomb. Fresh and deep fragmentation patterns could be seen that matched the jagged outline of the remains of the fiberglass cylinder.

Test 13

This test was the same as Test 12 except that the pipe bomb was contained in a 24 inches diameter fiberglass ring with a wall thickness of 0.75 inch. The ring was lined with 3 inches thick BLASTWRAP™ and a cover of FRAGLITE™, a chopped fiber, fragment stopping blanket made from DYNEEMA®, a high density polyethylene. The blanket had been folded twice and so represented a four-ply blanket. The underside of the blanket was lined with three inches of BLASTWRAP™ that covered the ring to protect the blanket from blast and high temperatures. The pipe bomb was placed centrally within the ring and detonated as in previous trials using an electric detonator.

Examination of the ring following the blast showed that fragments from the pipe bomb body had penetrated through the fiberglass ring. One end cap had also penetrated the ring. The FRAGLITE™ anti-ballistic blanket totally failed, and there was evidence of heat damage even through the blanket was protected by BLASTWRAP™. It appears that FRAGLITE™ is extremely temperature sensitive, and subsequent investigation has confirmed that DYNEEMA® fabric has a melting temperature of 150° C.

Test 14

This test consisted of a 24 inches piece of steel oil pipeline having a wall thickness of ⅜ inch. End caps ⅜ inch thick were welded in place, and the assembly was filled with water to replicate oil. A two-pound C4 uncased demolition charge was positioned against the side of the pipe and detonated. The charge punched a hole through the side of the pie, allowing the water to partially drain out.

Test 15

This shot was identical to the previous shot, except that a layer of BLASTWRAP™ had been introduced between the charge and the pipe. A fresh water filed pipe replaced the pipe that had been damaged.

The charge was detonated, and the BLASTWRAP™ was found to have protected the pipe from holing and had not produced any leaks. The end caps were slightly bulged, but the welds remained intact.

Test 16

This setup was identical to that in Test 15, except that the BLASTWRAP™ layer was replaced with a thinner, 3 inches thick, version. Another fresh pipe was positioned on the range. The 2 pound C4 charge was attached to the BLASTWRAP™ protective layer and detonated. The charge did not penetrate the pipe or cause any leakage.

Test 17

The charge fired in this test was a 12 inches long section of steel water pipe with an internal diameter of 2 inches. The pipe had been filled with ½ pound Hercules Green dot smokeless powder. One of the end caps had been drilled with a ¼ inch diameter hole through which a detonator was inserted to initiate the device.

The charge was fired in a 36 inches diameter by 36 inches high fiberglass cylinder having a wall thickness of 1.5 inch. A three inches layer of BLASTWRAP™ was positioned between the pipe bomb and the cylinder.

Following detonation of the pipe bomb, it was found that one end cap, the one opposite the detonator end, had punched through the cylinder wall. Delamination of the cylinder wall caused by fragment strike was visible.

Test 18

This test involved a ½ pound smokeless powder filed pipe bomb in a 24 inches diameter fiberglass ring. The wall thickness of 0.75 inch was lined with 3 inches thick BLASTWRAP™. The cover consisted of a KEVLAR® anti-ballistic material of eight plies stitched together. The blanket had a lining of three inches of BLASTWRAP™ over the area that covered the pipe. The pipe bomb was placed centrally within the ring and detonated as in previous trial using an electric detonator. The major difference in this trial was that the ring was wrapped in 21 layers of FRAGLITE™ wound around the ring by hand.

Examination of the remnants of the trial following detonation showed that no fragments penetrated the KEVLAR® blanket. The fiberglass ring had been penetrated by numerous fragments, including the end of the pipe. The fragments were captured by the FRAGLITE™ wrap, but the whereabouts of the end cap remain uncertain. No other fragments had escaped.

Test 19

The charge fired in this test was a ½ pound pipe bomb. The charge was fired in a 36 inches diameter by 36 inches high fiberglass cylinder with a wall thickness of 1.5 inch. A three inch layer of BLASTWRAP™ was positioned between the pipe bomb and the cylinder.

Following detonation of the pipe bomb, it was found that one end cap, the one opposite the detonator end, had punched through the cylinder wall. Delamination of the cylinder wall was visible.

Test 20

This test was identical to Test 19 except that the cylinder was 2.5 inches thick and the pipe bomb was initiated by burning fuse end rather than detonator.

Inspection following the trials showed that the end cap had not penetrated through the wall but had penetrated into the fiberglass wall by about 0.5 inch and then bounced out. There was some delamination at the rear face of the penetration.

Test 21

This test was conducted using an American Innovations trash receptacle. A charge equal to five pounds of TNT was placed centrally within the receptacle. The sides and base of the receptacle were lined with three inches of BLASTWRAP™, and the top was covered by a 6-inch layer of BLASTWRAP™.

Following detonation, the trash receptacle was examined, and no damage to the receptacle was found.

Test 22

This test was identical to Test 21 except that no BLASTWRAP™ was deployed. A slight split was found in the first internal steel layer at the base of the bin following detonation of the charge.

Test 23

This test was identical to Test 22 except that that the TNT equivalent was replaced by a ½ pound smokeless powder filled pipe bomb.

Some localized deformation of the bin was experienced, but no penetration of the bin.

Test 24

A charge equivalent to 20 pound of TNT was placed centrally in a cylinder 365 inches high by 36 inches internal diameter. The cylinder had a wall thickness of 2.5 inches, and the charge was suspended centrally inside the cylinder above the concrete base of the cylinder. The pressure for this charge calculated as a bare charge in gauges positioned at a distance of 21.5 feet were expected to be approximately 15.2 psi. Three inches of BLASTWRAP™ was applied to the internal diameter of the cylinder and the base of the cylinder.

The charge was detonated, after which a whistling smoke erring ensued. Following inspection of the suite, the fiber glass cylinder was found to have failed, but only to the extent that it had split into two pieces and the cylinder was moved sideways by about 6 feet.

The results of this testing are shown below:

Commercial in Confidence

FIG. 11: Failed safe: pieces of bin have moved around 6 foot

Discussion of Results

| No. | Charge size TNT Equivalent Pounds | Cylinder Thickness Inches | BlastWrap | Pressure Measured Psi | Pressure Predicted Psi | Pressure Reduction % | Equiv Charge Pound |
|---|---|---|---|---|---|---|---|
| 1 | 1 | 2.5 | None | 3.2 | 4.1 | 22 | 0.89 |
| 2 | 1 | 2.5 | L, B | 2.8 | 4.1 | 32 | 0.68 |
| 3 | 1 | 2.5 | L, 13, C | 1.64 | 4.1 | 60 | 0.22 |
| 4 | 1 | 2.5 | C | 2.3 | 4.1 | 41 | 0.45 |
| 5 | 5 | 2.5 | L, 13, C | 2.3 | 10 | 77 | 0.23 |
| 6 | 5 | 2.5 | None | 6.2 | 10 | 38 | 1.66 |
| 7 | 10 | 2.5 | L, B, C | 4.6 | 17 | 73 | 0.97 |
| 8 | 10 | 2.5 | None | 11.7 | 17 | 32 | 4.6 |
| 9 | 1 | NA | None | 4.1 | 3.4 to 4.7 | NA | 1 |
| 10 | 2 | 0.5 | None | 4.3 | 6 | 29 | 1.53 |
| 11 | 1 | 0.5 | L, B | 2.5 | 4.1 | 40 | 0.54 |
| 12 | 1/21b pipe bomb | 0.5 | None | NA | NA | NA | NA |
| 13 | 1/21b pipe bomb | 0.75 | None | NA | NA | NA | NA |
| 14 | 2.78 | NA | None | NA | NA | NA | NA |
| 15 | 2.78 | NA | 6. | NA | NA | NA | NA |
| 16 | 2.78 | NA | 3" | NA | NA | NA | NA |
| 17 | 1/21b pipe bomb | 1.5 | 3" strip | 2.2 | | NA | 0.41 |
| 18 | 1/21b pipe bomb | 0.75 FR | 3" | 2.1 | ? | NA | 0.37 |
| 19 | 1/21b pipe bomb | 1.5 | 3" strip | 1.9 | ? | NA | 0.30 |
| 20 | 1/21b pipe bomb | 2.5 | 3" strip | None | ? | NA | NA |
| 21 | 5 | Al can | L, B, C | 2.7 | 10 | 73 | 0.34 |
| 22 | 5 | Al can | None | 6 | 10 | 40 | 1.54 |
| 23 | 1/21b pipe bomb | Al can | None | 1.5 | ? | NA | 0.18 |
| 24 | 20 | 2.5 | L, B, XC | 5.1 | 15.2* | 66 | 3.49 |

Legend

= cylinder was lined with 3" BlastWrap

= cylinder had a 3" base of BlastWrap

= cylinder had a 3" cap of BlastWrap

It is to be understood that the phraseology or terminology employed herein is for the purpose of description and not of limitation. The means and materials for carrying out disclosed functions might take a variety of alternative forms without departing from the invention. Thus, the expressions "means to . . . " and "means for . . . " as may be found the specification above, and/or in the claims below, followed by a functional statement, are intended to define and cover whatever structural, physical, chemical, or electrical element or structures which may now or in the future exist for carrying out the recited function, whether or not precisely equivalent to the embodiment or embodiments disclosed in the specification above, and it is intended that such expressions be given their broadest interpretation.

REFERENCES

1. "Explosives Engineering", Paul Cooper. ISBN 0-471-18636-8
2. "Journal of Hazardous Materials", Vol 52-No.1, January 1997. ISSN 0304-3894.
3. Eric Lavonas, MD, FACEP, Department of Emergency Medicine, Divisions of Toxicology and Hyperbaric Medicine. Carolinas Medical Center.

What is claimed is:

1. A container for mitigating explosions comprising:

(a) a top, a bottom, and side, and wherein at least one of the top, the bottom, or the side is completely or partially lined with a shock attenuating material and an optional anti-ballistic material;

(b) wherein the shock attenuating material is in the form of an assembly of two flexible sheets arranged one over the other and joined by a plurality of seams, the seams being arranged so as to form cells or recesses in the space between the sheets, and wherein the cells or recesses are filled with a blast mitigating material which is perlite;

(c) wherein the top of the container is a removable lid, and the lid is completely or partially lined with a blast-attenuating material and an anti-ballistic material.

2. A container for mitigating explosions comprising:

(a) a top, a bottom, and side, and wherein at least one of the top, the bottom, or the side is completely or partially lined with a shock attenuating material and an optional anti-ballistic material;

(b) wherein the shock attenuating material is in the form of an assembly of two flexible sheets arranged one over the other and joined by a plurality of seams, the seams being arranged so as to form cells or recesses in the space between the sheets, and wherein the cells or recesses are filled with a blast mitigating material which is a mixture of perlite and a fusible fireproofing salt;

(c) wherein the top of the container is a removable lid, and the lid is completely or partially lined with a blast-attenuating material and an optional anti-ballistic material.

3. A container for mitigating explosions comprising:

(a) a top, a bottom, and side, and wherein at least one of the top, the bottom, or the side is completely or partially lined with a shock attenuating material and an optional anti-ballistic material;

(b) wherein the shock attenuating material is in the form of an assembly of two flexible sheets arranged one over the other and joined by a plurality of seams, the seams being arranged so as to form cells or recesses in the space between the sheets, and wherein the cells or recesses are filled with a blast mitigating material which is a mixture of perlite and a fusible fireproofing salt;

(c) wherein the top of the container is a removable lid, and the lid is completely or partially lined with a blast-attenuating material and a fusible salt.

* * * * *